US009644897B2

(12) United States Patent
Gu et al.

(10) Patent No.: US 9,644,897 B2
(45) Date of Patent: May 9, 2017

(54) HEATER CORE WITH DUAL PLATE PIPE CONNECTOR

(75) Inventors: Jung Sam Gu, Daejeon (KR); Yong Jun Jee, Daejeon (KR); Kwang Hun Oh, Daejeon (KR); Michael R. Farris, Van Buren Township, MI (US); Richard Kenneth Harris, Van Buren Township, MI (US); Evangelos S. Papoulis, Van Buren Township, MI (US)

(73) Assignee: HANON SYSTEMS, Daejeon-si (KR)

( * ) Notice: Subject to any disclaimer, the term of this patent is extended or adjusted under 35 U.S.C. 154(b) by 910 days.

(21) Appl. No.: 13/159,447

(22) Filed: Jun. 14, 2011

(65) Prior Publication Data

US 2011/0303402 A1 Dec. 15, 2011

(30) Foreign Application Priority Data

Jun. 15, 2010 (KR) ..... 10-2010-0056670
May 31, 2011 (KR) ..... 10-2011-0052125

(51) Int. Cl.

| | |
|---|---|
| ***F28D 1/00*** | (2006.01) |
| ***F28D 1/053*** | (2006.01) |
| ***F28F 9/02*** | (2006.01) |
| ***F28F 9/00*** | (2006.01) |
| *F28D 21/00* | (2006.01) |

(52) U.S. Cl.

CPC ..... *F28D 1/05366* (2013.01); *F28F 9/001* (2013.01); *F28F 9/0251* (2013.01); *F28D 2021/0096* (2013.01); *F28F 2009/0285* (2013.01); *F28F 2280/06* (2013.01)

(58) Field of Classification Search

CPC .. F28F 9/246; F28F 9/248; F28F 9/251; F28F 9/253; F28F 9/001; F28F 2009/0285; F28F 2280/06; F28D 1/05366; F28D 2021/0096

USPC ..... 165/178, 175, 149

See application file for complete search history.

(56) References Cited

U.S. PATENT DOCUMENTS

| | | | | |
|---|---|---|---|---|
| 4,860,823 | A * | 8/1989 | Noguchi | 165/153 |
| 5,042,577 | A * | 8/1991 | Suzumura | 165/153 |
| 5,529,117 | A | 6/1996 | Voss et al. | |
| 5,826,648 | A * | 10/1998 | Shimoya et al. | 165/153 |
| 5,964,281 | A * | 10/1999 | Voss et al. | 165/144 |
| 6,179,050 | B1 * | 1/2001 | Dey et al. | 165/149 |
| 6,196,306 | B1 * | 3/2001 | Aikawa et al. | 165/178 |
| 6,675,883 | B1 * | 1/2004 | De Keuster et al. | 165/173 |

(Continued)

FOREIGN PATENT DOCUMENTS

| | | | |
|---|---|---|---|
| DE | 1826522 A2 * | 8/2007 | F28F 9/001 |
| GB | 2 098 313 A | 11/1982 | |

(Continued)

OTHER PUBLICATIONS

EP 1826522A2 machine translation.*

European Search Report for corresponding European Application No. 11 00 4842, dated Oct. 7, 2015.

*Primary Examiner* — Len Tran

*Assistant Examiner* — Gordon Jones

(74) *Attorney, Agent, or Firm* — Hauptman Ham, LLP

(57) ABSTRACT

Provided is a heater core which has a simple structure using a pipe connector formed by coupling a first plate and a second plate, thereby facilely manufacturing it, and also which can have a smaller size, since an inlet pipe and an outlet pipe are disposed to be adjacent to each other.

22 Claims, 16 Drawing Sheets

(56) References Cited

U.S. PATENT DOCUMENTS

| | | | | |
|---|---|---|---|---|
| 7,059,050 | B2 * | 6/2006 | Calhoun et al. | 29/890.052 |
| 7,219,717 | B2 * | 5/2007 | Hanafusa | 165/153 |
| 2001/0010263 | A1 * | 8/2001 | Ichiyanagi | F28D 1/0341 165/178 |
| 2006/0005959 | A1 | 1/2006 | Maeda et al. | |
| 2010/0077794 | A1 * | 4/2010 | Higashiyama et al. | 62/515 |
| 2010/0218914 | A1 * | 9/2010 | Irmler | F02B 29/0475 165/67 |
| 2011/0214848 | A1 * | 9/2011 | Ninagawa et al. | 165/148 |

FOREIGN PATENT DOCUMENTS

| | | | |
|---|---|---|---|
| JP | H11 94398 | A | 4/1999 |
| JP | 2004 028393 | A | 1/2004 |
| JP | 2004-132599 | | 4/2004 |
| JP | 2004 132599 | A | 4/2004 |

* cited by examiner

HEATER CORE WITH DUAL PLATE PIPE CONNECTOR

RELATED APPLICATIONS

The present application is based on, and claims priority from, KR Application Number 10-2010-0056670, filed Jun. 15, 2010, and KR Application Number 10-2011-0052125, filed May 31, 2011, the contents of which are hereby incorporated by reference herein in their entireties.

BACKGROUND OF THE INVENTION

Field of the Invention

The present invention relates to a heater core, and more particularly to a heater core which has a simple structure using a pipe connector formed by coupling a first plate and a second plate, thereby facilely manufacturing it, and also which can have a smaller size, since an inlet pipe and an outlet pipe are disposed to be adjacent to each other.

Description of Related Art

Recently, in the automobile industry, as the concern for energy and environment has been increased globally, there has been research on the improvement of fuel efficiency, and research and development efforts for lighter weight, smaller size and multi-function has been steadily made to satisfy various demands of customers.

Particularly, a heater coil is used as a heating apparatus of a vehicle, in which heat exchange medium heated by engine heat is heat-exchanged with air and the heated air is supplied inside the vehicle.

However, since it is generally difficult to secure an enough space in an engine room, there have been many efforts to manufacture a heater core having a small size and high efficiency.

In a conventional heater core in which an inlet pipe and an outlet pipe are respectively connected to a first header tank and a second header tank, and thus a distance between the inlet pipe and the outlet pipe is so great.

However, in the majority of cases, it is necessary to reduce the distance between the inlet pipe and the outlet pipe in order to apply the heater core to a vehicle.

FIGS. 1*a* and 1*b* are perspective views of two kinds of conventional representative heater cores, wherein FIG. 1*a* shows a U-turn type heater core, and FIG. 1*b* shows a one-way type heater core.

Referring to FIGS. 1*a* and 1*b*, the conventional heater cores include first and second header tanks 21 and 22, an inlet pipe 25 which is connected to one of the first and second header tanks 21 and 22 so as to introduce heat exchange medium, an outlet pipe 26 which is connected to the other header tank so as to discharge the heat exchange medium, a plurality of tubes 23 which are fixed to both ends of the first and second header tanks 21 and 22 so as to form a fluid passage, and fins 24 which are interposed between the tubes 23.

Herein, in case of the U-turn type heater core shown in FIG. 1*a*, when it is inserted into an air conditioner case, the first and second header tanks 21 and 22 are positioned left and right so as to be spaced apart from each other at a predetermined distance, and thus an air flowing space as a heat exchange surface area is reduced. Hence, there is a problem in that heat exchange performance may be deteriorated.

Meanwhile, in case of the one-way type heater core shown in FIG. 1*b*, when it is inserted into an air conditioner case, the first and second header tanks 21 and 22 are positioned up and down so as to be spaced apart from each other at a predetermined distance, and thus it is possible to solve the problem that the heat exchange performance is deteriorated by the reduction in the heat exchange surface area of the U-turn type heater core.

However, since the inlet and outlet pipes 25 and 26 are respectively disposed at the first and second header tanks 21 and 22, it is difficult to apply the heater core to a vehicle in which it is required that the inlet and outlet pipes 25 and 26 are adjacent to each other.

To solve this problem, there has been proposed a heat exchanger disclosed in Japanese Patent Laid-Open No. 2004-132599. FIG. 2 shows the heat exchanger.

The heat exchanger shown in FIG. 2 includes a first plate 12 which is communicated with a first header tank 21 so as to form an introduction passage 11-1, a second plate 12 which is communicated with a second header tank 22 so as to form an discharge passage 12-1, and a flange 30 of which one side is connected with the first and second plates 11 and 12 and the other side is connected with inlet and outlet pipes 25 and 26.

The above-mentioned heat exchange has an advantage that the inlet and outlet pipes can be disposed to be adjacent to each other. However, since pressure in the introduction and discharge passages is rapidly increased, the heat exchange medium cannot flow smoothly, and thus the heat exchange performance is lowered.

SUMMARY OF THE INVENTION

An embodiment of the present invention is directed to providing a heater core which has a simple structure using a pipe connector formed by coupling a first plate and a second plate, thereby facilely manufacturing it, and also which can have a smaller size, since an inlet pipe and an outlet pipe are disposed to be adjacent to each other.

Another embodiment of the present invention is directed to providing a heater core that each of the first and second plates is formed with a tab portion, a tab hole, a bent portion, and a mounting groove in which a welding ring for welding with the inlet and outlet pipes is mounted, thereby increasing the coupling force, and also that the first and second plates are respectively formed with first and second grooves, thereby enhancing durability thereof.

Yet another embodiment of the present invention is directed to providing a heater core in which an extension portion is formed at a predetermined area of a second fluid passage forming portion, thereby securing a space defined in a flowing direction to the heater core by a first fluid passage forming portion and the second fluid passage forming portion, and also in which a first curved portion and a second curved portion are respectively formed at the first and second fluid passage forming portions, thereby reducing a flow resistance of the heat exchange medium.

To achieve the object of the present invention, the present invention provides a heater core including first and second header tanks which are parallelly disposed to be spaced apart from each other at a predetermined distance; a cap which is provided at both ends of the first and second header tanks; a plurality of tubes of which both ends are fixedly inserted into the first and second header tanks so as to form a fluid passage of heat exchange medium; fins which are interposed between the tubes; a side plate which supports the outmost tube or fin; an inlet pipe through which the heat exchange medium is introduced; and an outlet pipe through which the heat exchange medium is discharged, wherein supporting portions are protruded from both side ends of the side plate, and a pipe connector is formed at one side of the side plate, and the pipe connector 800 includes a first plate formed into a plate shape and including a first base portion formed with a first communication hole which is communicated with the first header tank and a second communication hole which is communicated with the second header tank, and a first fluid passage forming portion which is concave at a predetermined area of the first base portion so as to be mounted in a space defined by the supporting portion of the side plate; and a second plate including a plate type second base portion which is bonded to the first base portion of the first plate, a second fluid passage forming portion which is convex at a predetermined area of the second base portion so as to form the fluid passage of the heat exchange medium together with the first fluid passage forming portion of the first plate, an extension portion which is formed by further protruding a predetermined area of the second fluid passage forming portion opposed to the second header tank toward an outside of the heater core, a first connection portion which is protruded to an outside of the heater core so as to be connected with one of the inlet and outlet pipes, and a second connection portion which is parallelly adjacent to the first connection portion so as to be connected with the other one of the inlet and outlet pipes.

Preferably, in the pipe connector, the first plate is formed with a first pipe connection portion and a second pipe connection portion which are protruded toward a front or rear side of the heater core, and the second plate is formed with a third pipe connection portion corresponding to the first pipe connection portion and a fourth pipe connection portion corresponding to the second pipe connection portion, and one of the inlet and outlet pipes is connected to an end of the first and third pipe connection portions, and the other one is connected to an end of the second and fourth pipe connection portions.

Preferably, in the pipe connector, the first base portion of the first plate is formed with a tab portion, and the second plate is formed with a tab hole corresponding to the tab portion of the first plate.

Preferably, the first plate is formed with a bent portion which is formed by bending a predetermined area of the first base portion toward an outside of the supporting portion of the side.

Preferably, the bent portion is formed so as to be corresponding to a place in which the side plate is adjacent to the first or second header tank, such that an outer surface of the supporting portion is connected with the first or second header tank.

Preferably, the first base portion is formed with a protruded portion which is formed at one of the first and second communication holes so as to be inserted into the first or second header tank.

Preferably, in the side plate, a height of the supporting portion on the side that the pipe connector is formed is higher than a height of the supporting portion on the side that the pipe connector is not formed.

Preferably, a second hollowed portion is formed at a predetermined area of the second base portion, which is contacted with the first base portion.

Preferably, a height of the fluid passage defined by the first and second fluid passage forming portions is formed to be the same as a height of the fluid passage defined by the first base portion and the extension portion.

Preferably, the first fluid passage forming portion of the first plate is formed with a first curved portion which forms a gentle curved line together with a contacted portion with the cap, and the second fluid passage forming portion of the second plate is formed with a second curved portion, which forms a gentle curved line together with the extension portion, so as to be parallel with the first curved portion 621.

Preferably, in the pipe connector 800, the first connection portion is communicated with the first communication hole, and the second connection portion is formed at the second fluid passage forming portion, and the first fluid passage forming portion of the first plate is formed with an inclined portion which guides the heat exchange medium to the second connection portion.

Preferably, the first plate is formed with one or more first grooves that a predetermined area of the first fluid passage forming portion is protruded to the second fluid passage forming portion.

Further, the present invention includes a heater core including first and second header tanks which are parallelly disposed to be spaced apart from each other at a predetermined distance; a cap which is provided at both ends of the first and second header tanks; a plurality of tubes of which both ends are fixedly inserted into the first and second header tanks so as to form a fluid passage of heat exchange medium; fins which are interposed between the tubes; a side plate which supports the outmost tube or fin; an inlet pipe through which the heat exchange medium is introduced; and an outlet pipe through which the heat exchange medium is discharged, wherein supporting portions are protruded from both side ends of the side plate, and a pipe connector is formed at one side of the side plate, and the pipe connector includes a first plate formed into a plate shape and including a first base portion formed with a first communication hole which is communicated with the first header tank and a second communication hole which is communicated with the second header tank, and first and second fluid passage forming portions which are concave at a predetermined area of the first base portion so as to be mounted in a space defined by the supporting portion of the side plate and which are respectively communicated with the first and second communication holes; and a second plate including a plate type second base portion which is bonded to the first base portion of the first plate, a third fluid passage forming portion which is convex at a predetermined area of the second base portion so as to form the fluid passage of the heat exchange medium together with the first fluid passage forming portion of the first plate, a fourth fluid passage forming portion which is convex at a predetermined area of the second base portion so as to form the fluid passage of the heat exchange medium together with the second fluid passage forming portion of the first plate, extension portions which are formed by further protruding a predetermined area of the third fluid passage forming portion opposed to the first header tank and a predetermined area of the fourth fluid passage forming portion opposed to the second header tank toward an outside of the heater core, a first connection portion which is protruded to an outside of the heater core so as to be connected with one of the inlet and outlet pipes, and a second connection portion which is parallelly adjacent to the first connection portion so as to be connected with the other one of the inlet and outlet pipes.

Preferably, in the pipe connector, the first plate is formed with a first pipe connection portion and a second pipe connection portion which are protruded toward a front or rear side of the heater core, and the second plate is formed with a third pipe connection portion corresponding to the first pipe connection portion and a fourth pipe connection portion corresponding to the second pipe connection portion, and one of the inlet and outlet pipes is connected to an end of the first and third pipe connection portions, and the other one is connected to an end of the second and fourth pipe connection portions.

Preferably, in the pipe connector, the first base portion of the first plate is formed with a tab portion, and the second plate is formed with a tab hole corresponding to the tab portion of the first plate.

Preferably, the first plate is formed with a bent portion which is formed by bending a predetermined area of the first base portion toward an outside of the supporting portion of the side.

Preferably, the bent portion is formed so as to be corresponding to a place in which the side plate is adjacent to the first or second header tank, such that an outer surface of the supporting portion is connected with the first or second header tank.

Preferably, the first base portion is formed with a protruded portion which is formed at one of the first and second communication holes so as to be inserted into the first or second header tank.

Preferably, in the side plate, a height of the supporting portion on the side that the pipe connector is formed is higher than a height of the supporting portion on the side that the pipe connector is not formed.

Preferably, a second hollowed portion is formed at a predetermined area of the second base portion, which is contacted with the first base portion.

Preferably, a height of the fluid passage defined by the first and third fluid passage forming portions and a height of the fluid passage defined by the second and fourth fluid passage forming portions are formed to be the same as a height Lb of the fluid passage defined by the first base portion and the extension portion.

Preferably, the first and second fluid passage forming portions of the first plate are respectively formed with a first curved portion which forms a gentle curved line together with a contacted portion with the cap provided at the first and second header tanks, and the third and fourth fluid passage forming portions of the second plate are formed with a second curved portion, which forms a gentle curved line together with the extension portion, so as to be parallel with the first curved portion.

Preferably, in the pipe connector, the first connection portion is formed at the third fluid passage forming portion, and the second connection portion is formed at the fourth fluid passage forming portion, and the first and second fluid passage forming portions of the first plate are formed with an inclined portion which guides the heat exchange medium to the first and second connection portions.

Preferably, the first plate is formed with one or more first grooves that predetermined areas of the first and second fluid passage forming portions are protruded to the third and fourth fluid passage forming portions.

Figure 1A:
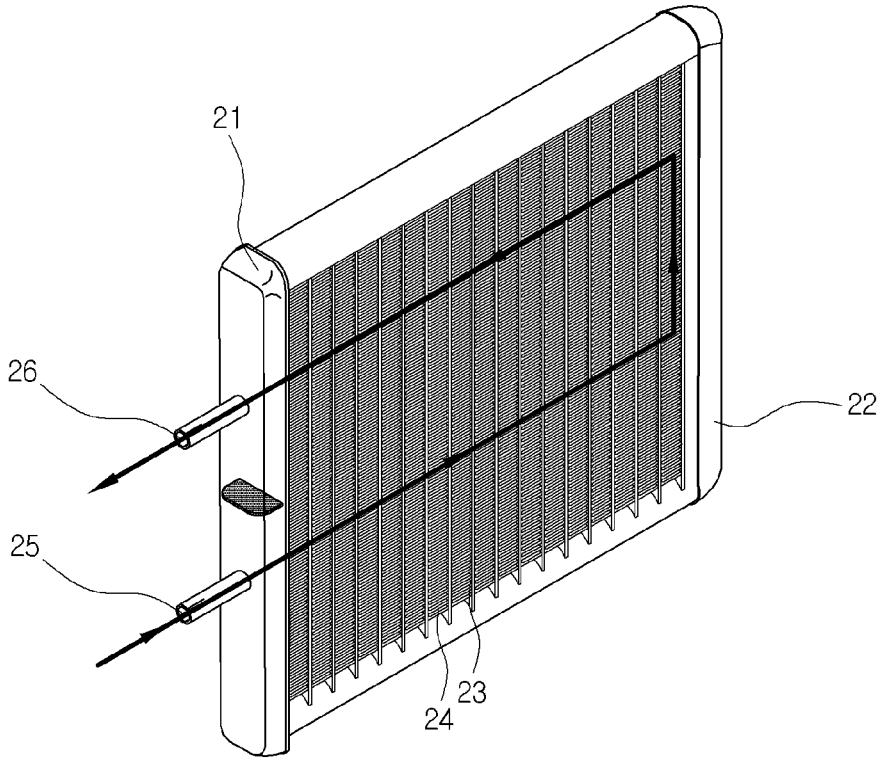
FIGS. 1*a* and 1*b* are perspective views of conventional heater cores.
Figure 1B:
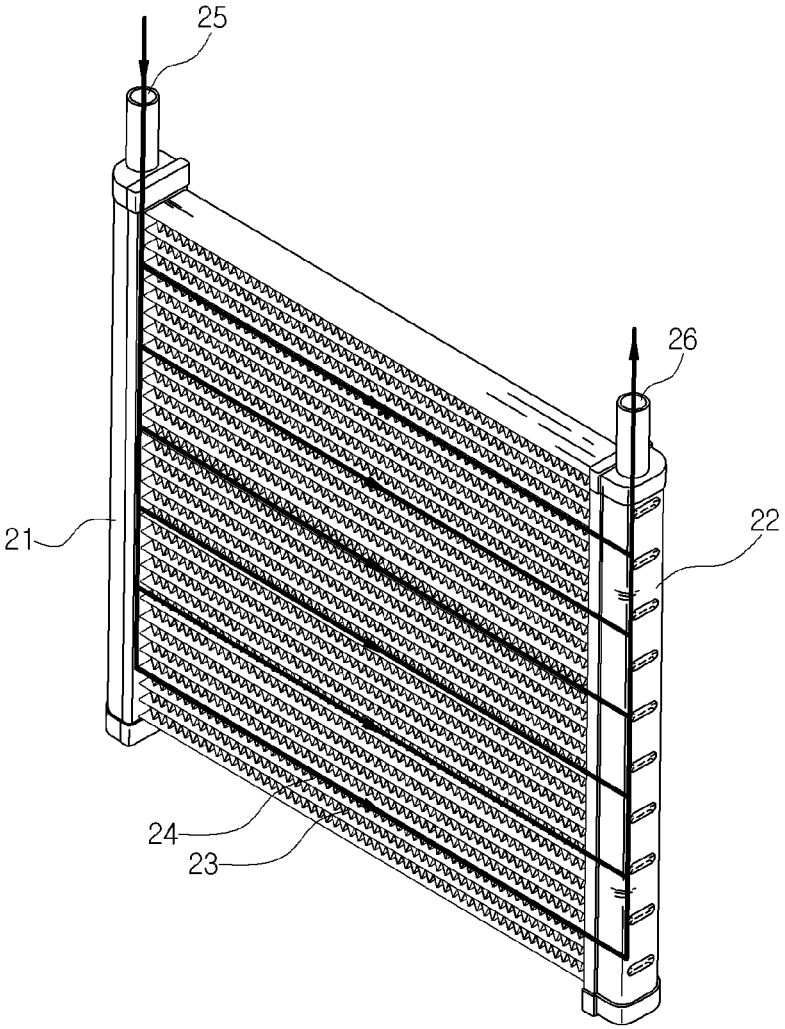
Figure 2:
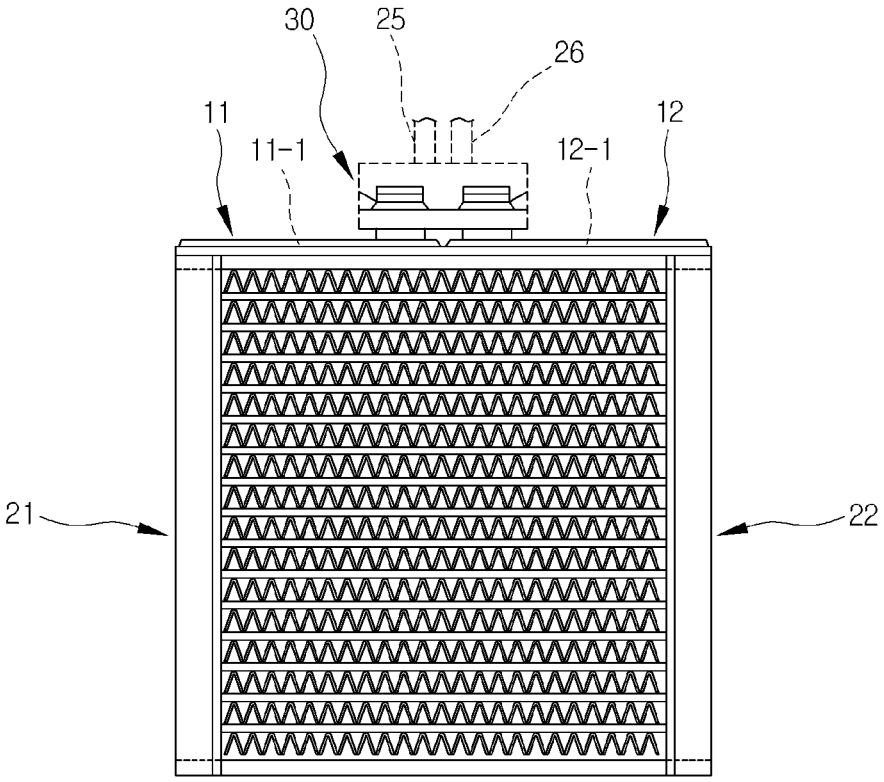
FIG. 2 is a cross-sectional view of a conventional heat exchanger.

| [Detailed Description of Main Elements] | |
|---|---|
| 1000: heater core | |
| 101: header | 102: tank |
| 130: cap | 200: tube |
| 300: side plate | 301, 302: supporting portion |
| 400: fin | |
| 510: inlet pipe | 520: outlet pipe |
| 530: welding ring | 600: first plate |
| 610: first base portion | 611: first communication hole |
| 612: second communication hole | |
| 613: protruded portion | 614: first hollowed portion |
| 615: first pipe connection portion | |
| 616: second pipe connection portion | |
| 620: first fluid passage forming portion | |
| 620-1: third fluid passage forming portion | |
| 620-2: fourth fluid passage forming portion | |
| 621: first curved portion | 622: first groove |
| 623: inclined portion | 630: tab portion |
| 640: bent portion | 700: second plate |
| 710: second base portion | 711: first connection portion |
| 712: second connection portion | |
| 713: burring portion | 714: second hollowed portion |
| 715: third pipe connection portion | |
| 716: fourth pipe connection portion | |
| 720: second fluid passage forming portion | |
| 720-1: fifth fluid passage forming portion | |
| 720-2: sixth fluid passage forming portion | |
| 721: extension portion | 722: second curved portion |
| 723: second groove | 730: tab hole |
| 800: pipe connector | |
| La: height of fluid passage defined by first and second fluid passage forming portions | |
| La-1: height of fluid passage defined first and third fluid passage forming portions | |
| La-2: height of fluid passage defined second and fourth fluid passage forming portions | |
| L: stepped portion | |

DESCRIPTION OF SPECIFIC EMBODIMENTS

The advantages, features and aspects of the invention will become apparent from the following description of the embodiments with reference to the accompanying drawings, which is set forth hereinafter.

A heater core 1000 of the present invention includes a first header tank 110, a second header tank 120, a cap 130, a tube 200, fins 400, a side plate 300, an inlet pipe 510, an outlet pipe 520 and a pipe connector 800.

First of all, the first and second header tanks 110 and 120 are parallelly disposed so to be spaced apart from each other at a predetermined distance. Each of the first and second header tanks 110 and 120 is formed by coupling of a header 101 and a tank 102.

The cap 130 is provided at both ends of the first and second header tanks 110 and 120. The cap 130 located at the side that the pipe connector 800 is provided (i.e., the heat exchange medium is introduced and discharged) is hollowed at a predetermined area thereof so as to be communicated with an inside thereof.

The tube 200 is fixedly inserted into both ends of the first and second header tanks 110 and 120, which are disposed to be spaced apart from each other at a predetermined distance, so as to form a passage of the heat exchange medium. The fin 400 is interposed between the tubes 200.

Like the tube 200, the side plate 300 is fixed to the both ends of the first and second header tanks 110 and 120 so as to support the tube 200 and the fin 400 at both sides of the heater core 1000.

Herein, the side plate 300 is provided in one pair at the both sides of the heater core 1000. The side plate 300 is connected with the pipe connector 800.

Both side ends of the side plate 300 are protruded in a transverse direction, and a supporting portion 301, 302 is formed so that the side plate 300 has a 'ㄷ' shape in section. The reference numeral 301 is the supporting portion formed at the side that the pipe connector 800 is connected, and the reference numeral 302 is the supporting portion formed at the side that the pipe connector 800 is not connected.

Since a height of the supporting portion 301 formed at the side that the pipe connector 800 is connected is a portion that forms an interface surface with the pipe connector 800, the height is formed to be higher than that of the supporting portion 302 formed at the side that the pipe connector 800 is not connected.

The pipe connector 800 is disposed so as to be contacted with the first header tank 110, the side plate 300 and the second header tank 120, such that the inlet pipe 510 and the outlet pipe 520 are connected with each other and also the heat exchange medium is introduced into the first header tank 110 or the second header tank 120, or the heat exchange medium is discharged from the first header tank 110 or the second header tank 120.

A structure of the pipe connector 800 will be described below.

The pipe connector 800 consists of a first plate 600 and the second plate 700.

The first plate 600 is disposed at one side surface of the heater core 1000 contacted with the first header tank 110, the side plate 300 and the second header tank 120. The first plate 600 includes a first base portion 610, a first fluid passage forming portion 620 and a tab portion 630.

The first base portion 610 is a base plate forming the first plate 600. The first base portion 610 is formed with a first communication hole 611 which is communicated with a first header tank 110, and a second communication hole 612 which is communicated with a second header tank 120.

The first base portion 610 is contacted with an end of the first header tank 110, a side of the side plate 300 and an end of the second header tank 120 so as to be corresponding to a side surface of the heater core 100.

To this end, the first base portion 610 has a width corresponding to the side plate 300, and the width of the first base portion 610 is gradually increased toward both ends so that the both ends of the first base portion 610 are correspondent to the cap 130.

That is, a center area of the first base portion 610 is formed to have the width corresponding to the side plate 300, and both end areas of the first base portion 610 are formed to have the width corresponding to each cap 130 disposed at the first and second header tanks 110 and 120. The width is increased from the center area toward the both end areas, and also a gentle slope is formed.

In other words, the first base portion 610 is formed to be contacted with the side plate 300 and the cap 130 provided at the ends of the first and second header tanks 110 and 120, thereby providing the durability.

Further, since the first and second header tanks 110 and 120 are disposed to be spaced apart from each other at a predetermined distance, the first and second communication holes 611 and 162 of the first base portion 610 are also disposed to be spaced apart from each other at a predetermined distance.

Herein, one of the first and second communication holes 611 and 162 may has a protruded portion 613 which is inserted into one of the first and second header tanks 110 and 120.

Figure 4:
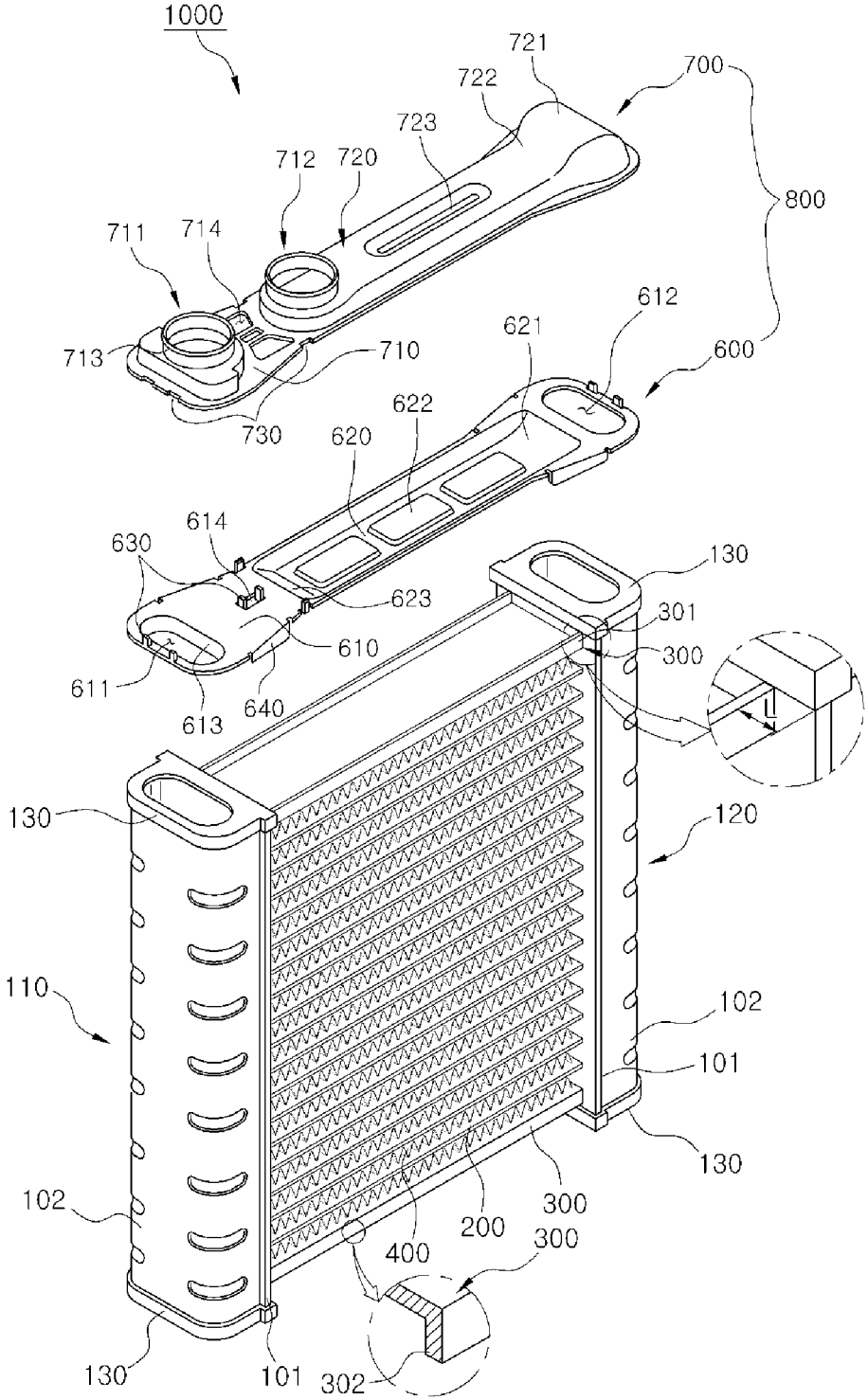
FIG. 4 is an exploded perspective view of the heater core shown in FIG. 3.

In FIG. 4, the first communication hole 611 is communicated with the first header tank 110, and the second communication hole 612 is communicated with the second header tank 120, and the protruded portion 613 is formed at the first communication hole 611. However, the heater core 1000 of the present invention is not limited to this.

The protruded portion 613 functions to determine a reference position for fixing the first plate 600. Preferably, the protruded portion 613 is formed at one of the first and second communication holes 611 and 612 in order to enhance assembling ability of the first plate 600.

The first fluid passage forming portion 620, which is formed at a predetermined area of the first base portion 610 to be recessed, is contacted with the side plate 300 and then fixed thereto.

Herein, the first fluid passage forming portion 620 is fixedly mounted in an internal space formed by the supporting portion 301 of the side plate 300, and a sealant is provided therebetween.

In general, a heat exchange portion formed by the tube 200 and the side plate 300 is formed more inside than the first and second header tanks 110 and 120. By forming the first fluid passage forming portion 620, the first plate 600 is contacted with the side plate 300, thereby securing the durability and also securing the flowing space of the heat exchange medium introduced or supplied to the second header tank 120.

Figure 3:
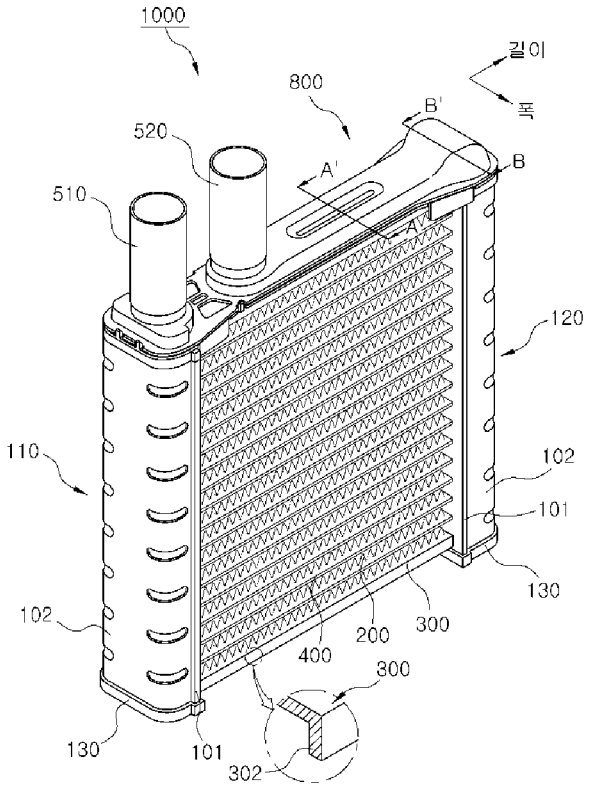
FIG. 3 is a perspective view of a heater core according to the present invention.
Figure 5:
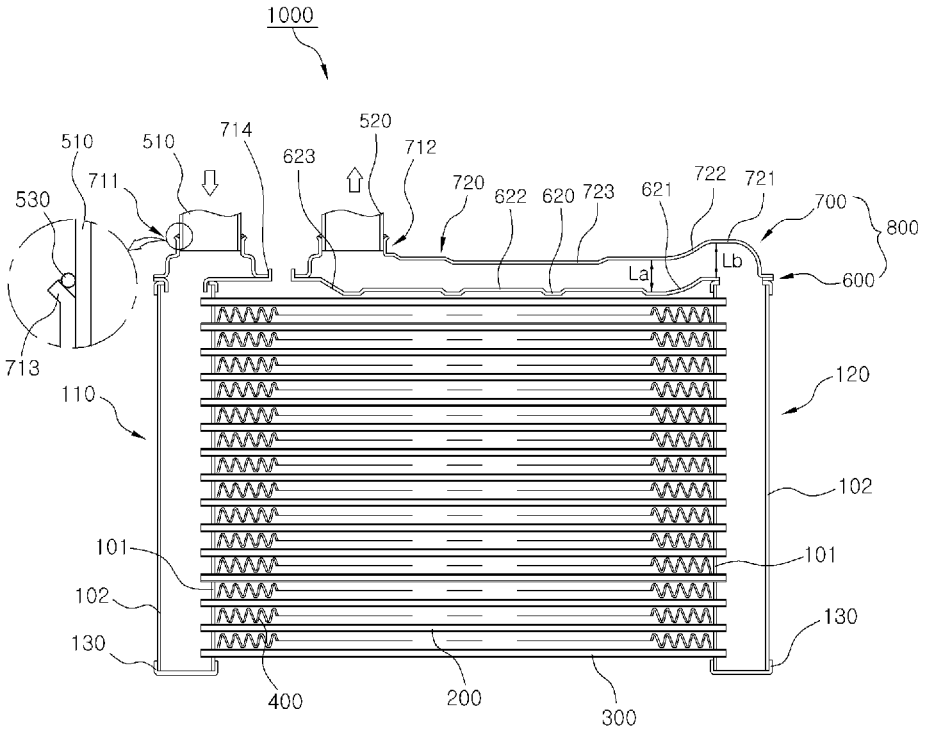
FIG. 5 is a longitudinal cross-sectional view of the heater core shown in FIG. 3.
Figure 6:
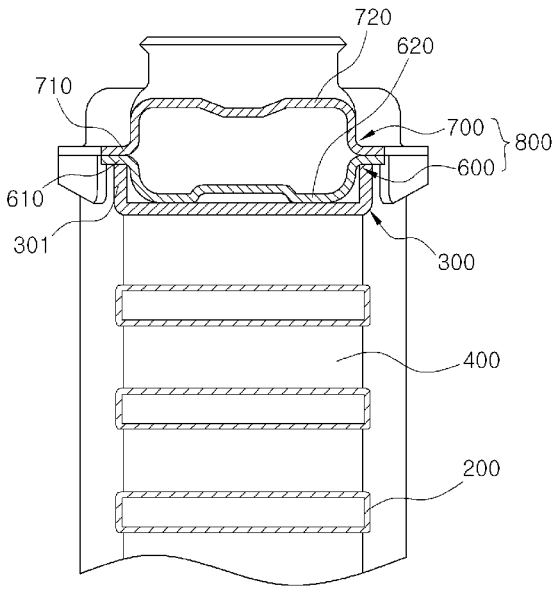
FIGS. 6 and 7 are cross-sectional views taken along lines A-A' and B-B' of the heater core shown in FIG. 3.
Figure 7:
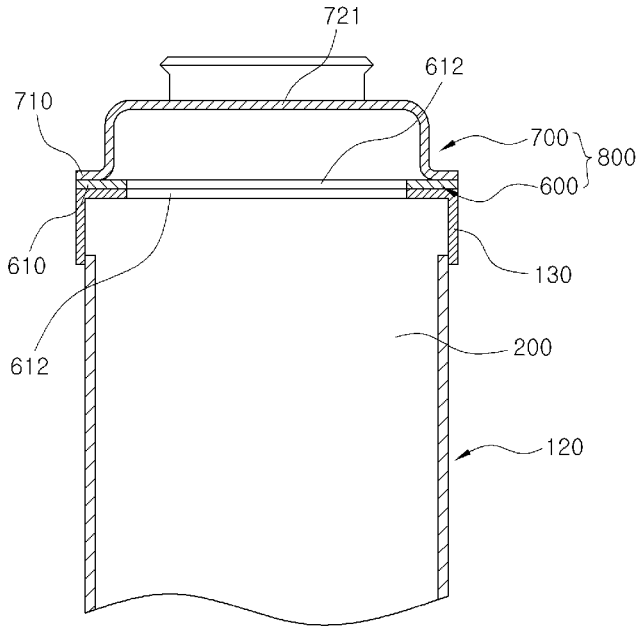

The recessed shape of the first fluid passage forming portion 620 is to form the flowing space of the heat exchange medium when being coupled with the second plate 700. As shown in FIGS. 3 to 5, the first fluid passage forming portion 620 is formed to be contacted with the side plate 300 based on the first base portion 610 coupled to the first or second header tank 110 or 120.

Further, in order to enhance the durability, the first plate 600 may be formed with one or more first grooves 622 in which the first fluid passage forming portion 620 is protruded to a second fluid passage forming portion 720.

The first groove 622 functions to improve brazing performance and whole durability. In FIG. 4, three first grooves 622 are provided so as to be spaced apart in a length direction of the first plate 600.

In other words, the first groove 622 is formed to be protruded inside the first fluid passage forming portion 620, thereby improving the brazing performance.

The tab portion 630 is formed at the first base portion 610 so as to be fixed to the second plate 700. A predetermined area of the tab portion 630 may be formed to be inclined to an outside of the heater core 1000, and also the tab portion 630 may be formed into various shapes according to the shape and size of the first plate 600.

In case of the tab portion 630 formed at an edge of the first base portion 610, a predetermined part of the tab portion 630 is cut away, and a remained part is bent outside the heater core 1000 (i.e., on the side that the second plate 700 is provided).

Further, in case of the tab portion 630 formed inside the first base portion 610 (i.e., which is coupled with the second base portion 710), the tab portion 630 is partially cut away, and a first hollowed portion 614 may be formed to be corresponding to an area of the tab portion 630.

Preferably, a bent portion 640 bent toward the tube 200 is further formed at a predetermined area of the first base portion 610 of which a width is gradually increased.

The bent portion 640 may be formed to be spaced apart at a predetermined distance in a length direction of the first plate 600 and formed into a trapezoidal shape, thereby minimizing scrap.

The bent portion 640 is bent toward the tube 200 so as to prevent air from being passed through a non-bonded portion between the first plate 600 and the side plate 300. The bent portion 640 also functions to improve attachability of a sealant, thereby increasing the durability.

Specially, the bent portion 640 allows the sealant to be air-tightly attached to a stepped portion L formed at an adjacent surface between the side plate 300 and the first or second header tank 110 or 120, thereby improving coupling force. Therefore, the bent portion 640 provides a mounting surface for the sealant.

Figure 12:
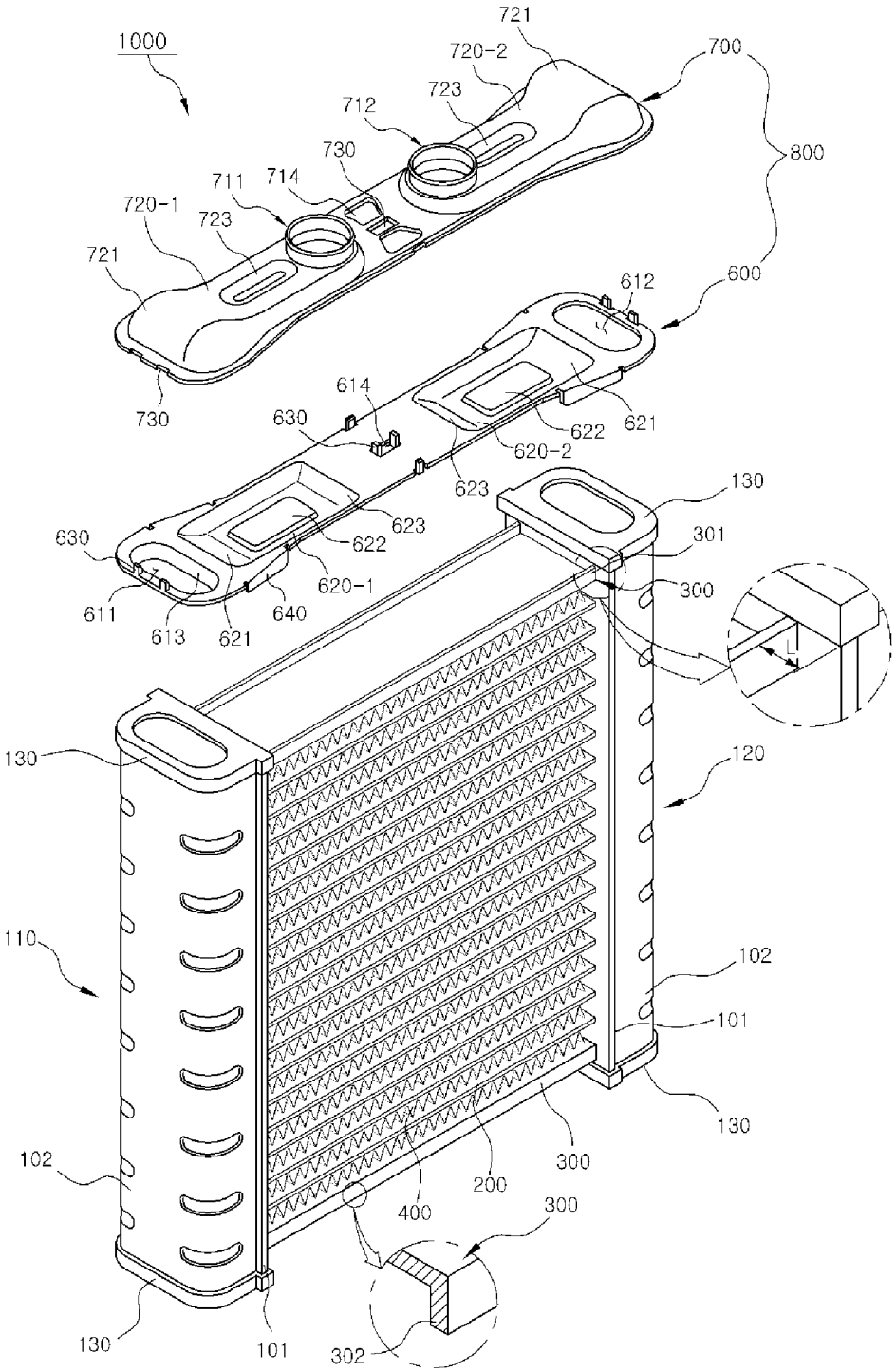
Figure 15:
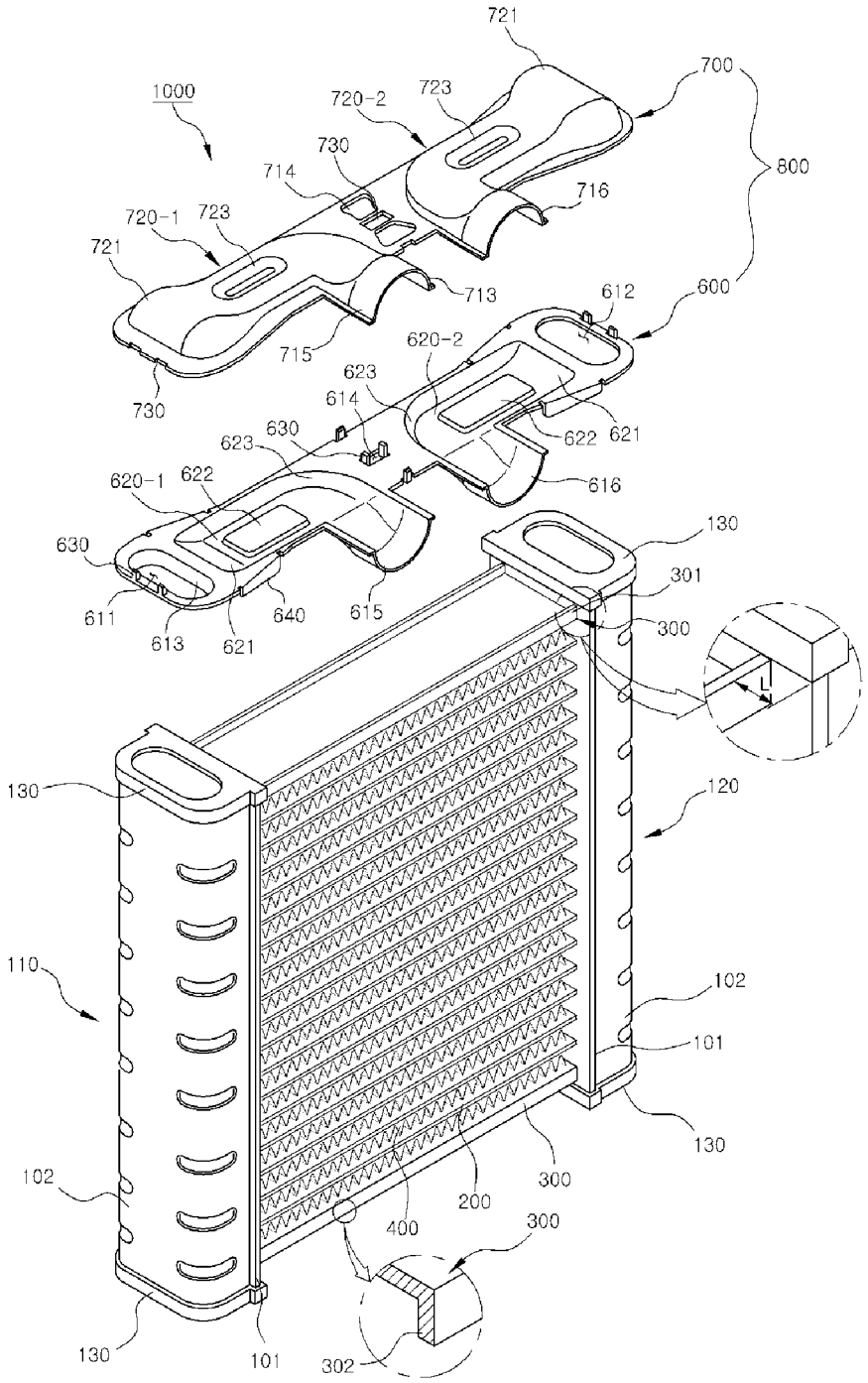

As shown in FIGS. 4, 12 and 15, when viewing a heat exchanger 1000 from a side thereof, the stepped portion L forms in a transverse direction between the side plate 300 and the first and second header tanks 110 and 120.

Meanwhile, the second plate 700 is coupled with the first plate 600. The second plate 700 includes a second base portion 710 and a second fluid passage forming portion 720.

The second base portion 710 is formed into a plate shape corresponding to the first base portion 610 of the first plate 600 and coupled with the first base portion 610.

That is, the first and second base portions 610 and 710 are surface-contacted with each other. The second base portion 710 may be also formed with a second hollowed portion 714 in order to enhance the brazing performance.

Further, the second hollowed portion 714 allows to check a leakage of the heat exchange medium, which exerts a bad influence on heat transfer performance of the heater core. Therefore, it is possible to confirm whether the first and second plates 600 and 700 are bonded well to each other.

More detailedly, in case that the first and second plates 600 and 700 are not bonded well to each other, the heat exchange medium flowed in the pipe connector 800 is leaked through the second hollowed portion 714 to an outside, thereby checking the whether the first and second plates 600 and 700 are bonded well to each other.

The second base portion 710 is hollowed so as to be communicated with the first communication hole 611 of the first plate 600. The second base portion 710 is also provided with a first connection portion 711 which is protruded to an outside of the heater core 1000 so as to be connected with one of the inlet pipe 510 and the outlet pipe 520, and a second connection portion 712 which is parallelly adjacent to the first connection portion 711 so as to the other one.

In other words, the second base portion 710 has the first and second connection portions 711 and 712 which are connected with the inlet and outlet pipes 510 and 520. Herein, the first connection portion 711 is formed to be corresponding to the first communication hole 611 of the first base portion 610, and the second connection portion 712 is parallelly adjacent to the first connection portion 711, and thus the inlet and outlet pipes 510 and 520 are disposed to be adjacent to each other.

The first and second connection portions 711 and 712 are formed to be protruded toward the outside of the heater core 1000 so as to be connected with the inlet and outlet pipes 510 and 520. In the present invention, the inlet and outlet pipes 510 and 520 may be connected with a front side or a rear side of the heater core 1000, as described below.

In the drawings, the inlet pipe 510 is connected to the first connection portion 711, and the outlet pipe 520 is connected to the second connection portion 712. However, the present invention is not limited to this example, and the inlet and outlet pipes 510 and 520 may be connected reversely.

The second plate 700 is formed with the second fluid passage forming portion 720 which is communicated with the second connection portion 712 and formed to be convex at a predetermined area of the second base portion 710 so as to form a passage of the heat exchange medium together with the first fluid passage forming portion 620.

That is, in the second plate 700, the first connection portion 711 is formed so that one of the inlet and outlet pipes 510 and 520 is correspondent to the first communication hole 611 of the first plate 600, and the second connection portion 712 is formed to be adjacent to the first connection portion 711, such that the inlet and outlet pipes 510 and 520 are adjacent to each other.

Herein, it is preferable that each of the first and second connection portions 711 and 712 is formed with a burring portion 713 on which a welding ring 530 for connecting the inlet and outlet pipes 510 and 520 is mounted.

In other words, the burring portion 713 is formed at an outer circumference of an end of each first and second connection portion 711, 712. Therefore, a welding process of the inlet and outlet pipes 510 and 520 is performed more facilely by mounting the welding ring 530 on the burring portion 713.

Accordingly, in the heater core 1000 of the present invention, since the inlet and outlet pipes 510 and 520 are parallelly adjacent to each other, and thus the welding process is performed facilely and the durability is improved.

One end of the fluid passage of the heat exchange medium, which is formed by the first and second fluid passage forming portions 620 and 720, is communicated with the second connection portion 712 of the second plate 700, and the other end thereof communicated with the second communication hole 612 of the first plate 600.

In the present invention, the second fluid passage forming portion 720 is formed to be convex. In other words, the second fluid passage forming portion 720 is formed to be protruded to an outside of the heater core 1000, i.e., in an upper direction of FIGS. 3 to 5, so as to form the fluid passage of the heat exchange medium together with the first fluid passage forming portion 620.

The second fluid passage forming portion 720 may be formed with one or more second grooves 723 which are protruded toward the first fluid passage forming portion 620. In the drawing, one second groove 723 is provided in a length direction.

Since the heater core 1000 of the present invention is formed with the second groove 723, it is possible to improve the brazing performance and the whole durability.

Herein, an extension portion 721 is formed at a predetermined area of the second fluid passage forming portion 720, which is opposed to the second header tank 120, so as to be further protruded to the outside of the heater core 1000.

The extension portion 721 is formed to be further protruded at the second header tank 120 compared with the side plate 300 and thus to secure a space for the fluid passage of the heat exchange medium at a portion that the second header tank 120 is located. In the heater core 1000 of the present invention, since the extension portion 721 is formed at the second fluid passage forming portion 720, it is possible to minimize a flow resistance of the heat exchange medium.

Particularly, in the heater core 1000 of the present invention, it is possible to control each height of the first fluid passage forming portion 620, the second fluid passage forming portion 720 and the extension portion 721. Preferably, a height La of the fluid passage defined by the first and second fluid passage forming portions 620 and 720 is the same as a height Lb of the fluid passage defined by the first base portion 610 and the extension portion 721. (referring to FIG. 5)

Furthermore, in the heater core 1000 of the present invention, the first fluid passage forming portion 620 of the first plate 600 is formed with a first curved portion 621 which forms a gentle curved line together with a contacted portion with the cap 130, and the second fluid passage forming portion 720 of the second plate 700 is formed with a second curved portion 722, which forms a gentle curved line together with the extension portion 721, so as to be parallel with the first curved portion 621.

That is, since the first fluid passage forming portion 620 is formed with the first curved portion 621 which guides the heat exchange medium to the second header tank 120, and the second fluid passage forming portion 720 is formed with the second curved portion 722 which is parallel with the first curved portion 621, the heater core 1000 of the present invention has an advantage that the fluid passage of the heat exchange medium defined by the first and second fluid passage forming portions 620 and 720 has an additional space formed in a flow direction of the heat exchange medium so as to minimize the flow resistance of the heat exchange medium and thus to prevent a sudden change in pressure.

Further, in the heater core 1000 of the present invention, it is preferable that the first fluid passage forming portion 620 of the first plate 600 is formed with an inclined portion 623 so as to guide the flow of the heat exchange medium through the second connection portion 712, such that the heat exchange medium introduced or discharged through the second connection portion 712 is smoothly flowed.

Figure 8:
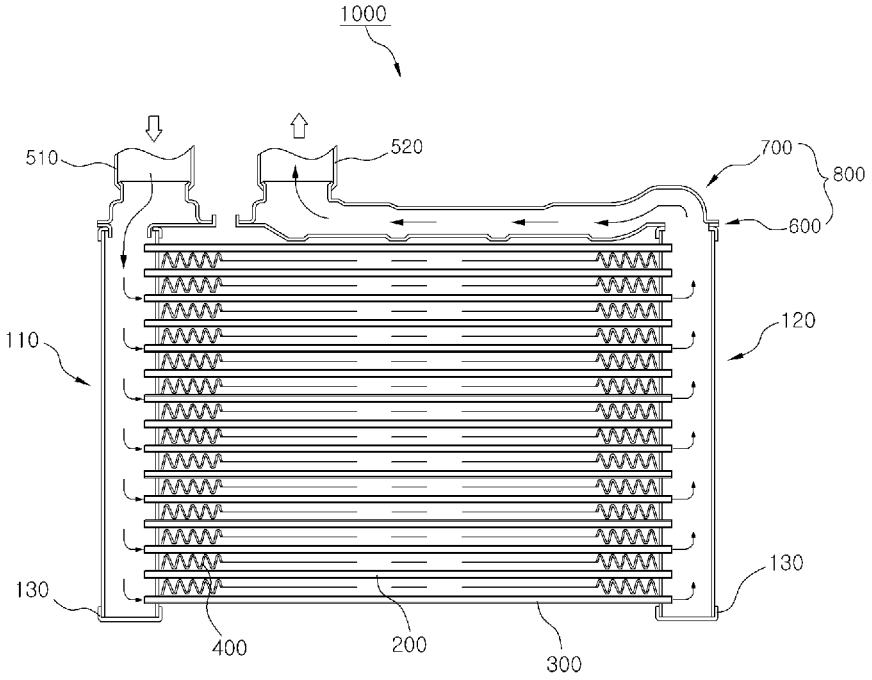
FIG. 8 is a view showing an example of a flow of heat exchange medium in the heater core according to the present invention.

The inclined portion 623 is to connect the first base portion 610 and the second fluid passage forming portion 620. In FIG. 8, the heat exchange medium in the fluid passage of the heat exchange medium (defined by the first and second fluid passage forming portions 620 and 720) is passed through the second connection portion 120 along the inclined portion 623 and then discharged through the outlet pipe 520.

The tab hole 730 is formed at the second base portion 720 of the second plate 700 so as to be corresponding to the tab portion 630 of the first plate 600.

The first and second plates 600 and 700 are temporarily assembled by coupling the tab portion 630 with the tab hole 630, and then integrally assembled with heater core 1000 by brazing.

FIG. 8 is an embodiment showing the flow of the heat exchange medium in the heater core 1000 according to the present invention. The heat exchange medium introduced from the inlet pipe 510 is flowed into the first header tank 110 through the first connection portion 711 of the second plate 700, the first communication hole 611 of the first plate 600, and the cap 130 provided at the end of the first header tank 110, and then flowed to the second header tank 120 through each tube 200.

The heat exchange medium flowed to the second header tank 120 is discharged to the outlet pipe 520 through the cap 130 provided at the end of the second header tank 120, the second communication hole 612 of the first plate 600, the fluid passage (defined by the first and second fluid passage forming portions 620 and 720) of the heat exchange medium, and the second connection portion 712 of the second plate 700.

In the heater core 1000 of FIG. 8, the inlet pipe 510 is disposed at the first connection portion 711 of the second plate 700, and the outlet pipe 520 is disposed at the second connection portion 712 of the second plate 700. The inlet pipe 510 and the outlet pipe 520 may be disposed reversely.

Figure 9:
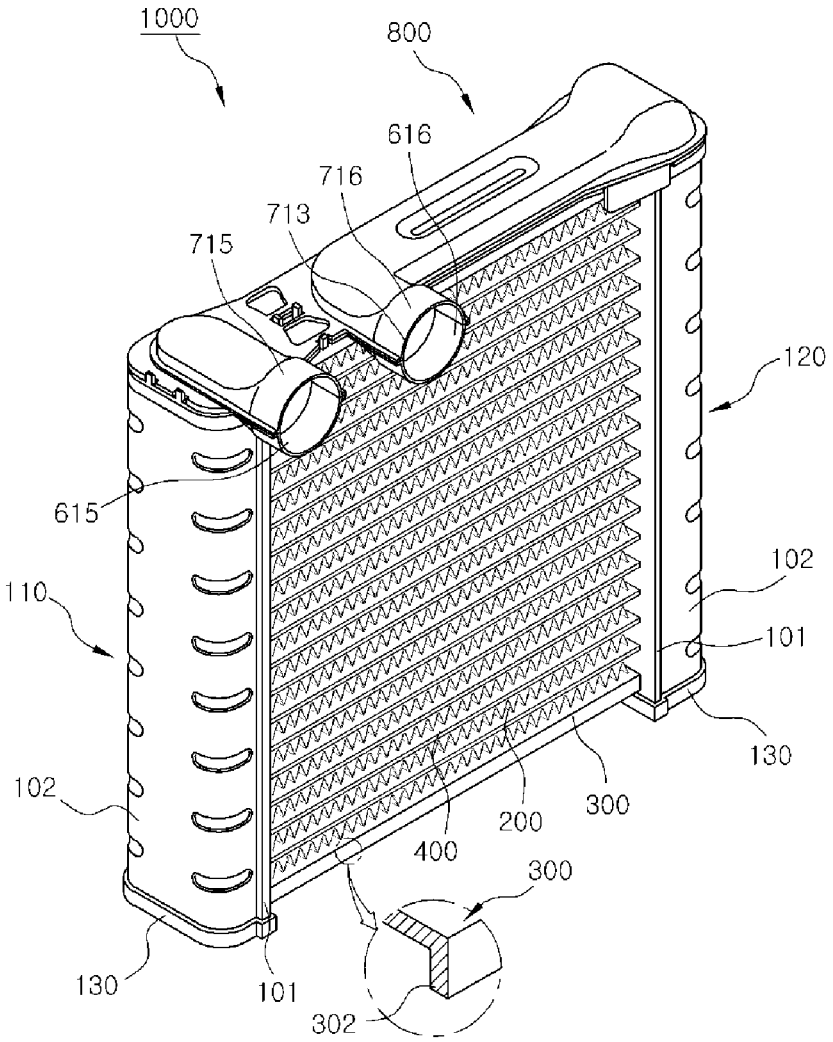
FIGS. 9 and 10 are a perspective view and a cross-sectional view of a heater core according to another embodiment of the present invention.
Figure 10:
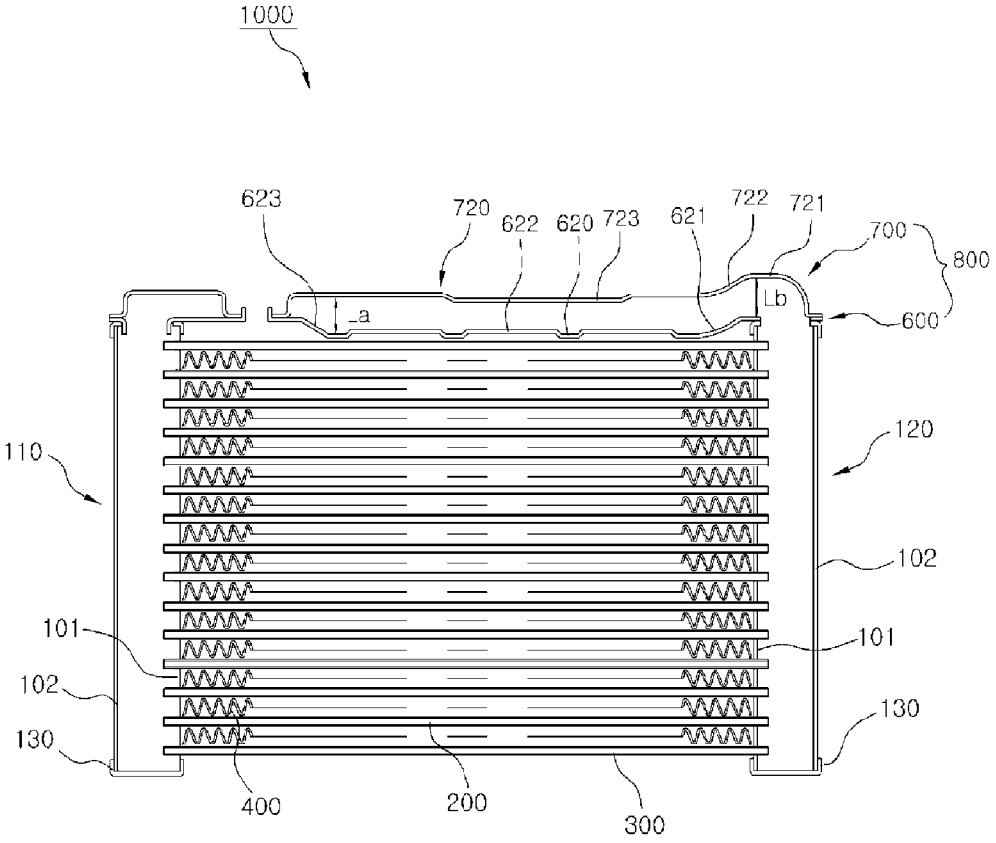

FIGS. 9 and 10 show another heater core 1000 according to the present invention, wherein the heater core 1000 has the same structure as that in the above-mentioned embodiment, but instead of the first and second connection portions 711 and 712, the first plate 600 is formed with a first pipe connection portion 615 and a second pipe connection portion 616, and the second plate 700 is formed with a third pipe connection portion 715 and a fourth pipe connection portion 716.

Herein, the first pipe connection portion 615 of the first plate 600 and the third pipe connection portion 715 of the second plate 700 are coupled with each other in an extended direction so as to form a space for the flow of the heat exchange medium, and one of the inlet and outlet pipes 510 and 520 is then connected thereto.

Further, the second pipe connection portion 616 of the first plate 600 and the fourth pipe connection portion 716 of the second plate 700 are coupled with each other in an extended direction so as to form a space for the flow of the heat exchange medium, and the other one of the inlet and outlet pipes 510 and 520 is then connected thereto.

That is, in order to connect the inlet and outlet pipes 510 and 520 to a side surface of the heater core 1000, the first plate 600 is formed with the first and second pipe connection portions 615 and 616, and the second plate 600 is formed with the third pipe connection portion 715 corresponding to the first pipe connection portion 615 and the fourth pipe connection portion 716 corresponding to the second pipe connection portion 616.

Due to the above construction, the heater core 1000 of the present invention has an advantage that the inlet and outlet pipes 510 and 520 are facilely connected using the first and second plates 600 and 700 forming the pipe connector 800 without a separate member.

The burring portion 713, on which the welding ring 530 for connecting the inlet and outlet pipes 510 and 520 is mounted, may be formed at each end of the first and third pipe connection portions 615 and 715 and the second and fourth pipe connection portions 616 and 716.

Meanwhile, FIGS. 11 to 16 show another heater core 1000 according to the present invention, wherein the heater core 1000 has the same structure as that shown in FIGS. 9 and 10, but the inlet and outlet pipes 510 and 520 are formed at a center portion of the side plate 300, and thus two fluid passages are formed at both sides of the side plate 300.

More detailedly, in the first plate 600, a predetermined area of the first base portion 610 is formed to be concave and thus mounted in a space formed by the supporting portion 301 of the side plate 300. Further, instead of the first fluid passage forming portion 620 in the above-mentioned embodiment, the first plate 600 is formed with a third fluid passage forming portion 620-1 and a fourth fluid passage forming portion 620-2 which are communicated with the first and second communication holes 611 and 612.

The third fluid passage forming portion 620-1 is communicated with the first communication hole 611, mounted in the space formed by the supporting portion 301 of the side plate 300, and fixed by the sealant.

The fourth fluid passage forming portion 620-2 is communicated with the second communication hole 612, mounted in the space formed by the supporting portion 301 of the side plate 300, and fixed by the sealant.

In addition, instead of the second fluid passage forming portion 720 in the above-mentioned embodiment, the second plate 700 is formed with a fourth fluid passage forming portion 720-1 which forms the fluid passage of the heat exchange medium together with the third fluid passage forming portion 620-1 of the first plate 600, and a sixth fluid passage forming portion 720-2 which forms the fluid passage of the heat exchange medium together with the fourth fluid passage forming portion 620-2 of the first plate 600.

The fourth fluid passage forming portion 720-1 is formed at a desire area of the second base portion 710 to be convex and thus to form the fluid passage of the heat exchange medium together with the third fluid passage forming portion 620-1. The fourth fluid passage forming portion 720-1 is formed with a first connection portion 711 which is protruded outside the heater core 1000 so as to be connected with one of the inlet and outlet pipes 510 and 520.

The sixth fluid passage forming portion 720-2 is formed at a desire area of the second base portion 710 to be convex and thus to form the fluid passage of the heat exchange medium together with the fourth fluid passage forming portion 620-2. The sixth fluid passage forming portion 720-2 is formed with a second connection portion 712 which is connected with the other one of the inlet and outlet pipes 510 and 520.

Herein, the second plate 700 is also formed with the extension portion 721 so that predetermined areas of the fourth fluid passage forming portion 720-1 opposed to the first header tank 110 and the sixth fluid passage forming portion 720-2 opposed to the second header tank 120 are further protruded to the outside of the heater core 1000.

The extension portion 721 is protruded to an outside of the heater core 1000 so as to be corresponding to a portion protruded by the formation of the cap 130.

Preferably, a height La-1 of the fluid passage defined by the third and fifth fluid passage forming portions 620-1 and 720-1 and a height La-2 of the fluid passage defined by the fourth and sixth fluid passage forming portions 620-2 and 720-2 are the same as a height Lb of the fluid passage defined by the first base portion 610 and the extension portion 721.

In other words, even though the cap 130 is provided, the fluid passage formed by the pipe connector 800 is sufficiently formed due to the formation of the extension portion 721.

Preferably, the third and fourth fluid passage forming portions 620-1 and 620-2 of the first plate 600 is formed with a first curved portion 621 which forms a gentle curved line together with a contacted portion with the cap 130 provided at the first and second header tanks 110 and 120, and the third and fourth fluid passage forming portions 720-1 and 720-2 of the second plate 700 is formed with a second curved portion 722 which forms a gentle curved line together with the extension portion 721, such that the heat exchange medium is smoothly flowed in the fluid passage defined by the third and fifth fluid passage forming portions 620-1 and 720-1 and the fluid passage defined by the fourth and sixth fluid passage forming portions 620-2 and 720-2.

Preferably, the third and fourth fluid passage forming portions 620-1 and 620-2 of the first plate 600 are formed with an inclined portion 623 so as to guide the heat exchange medium to first and second the second connection portions 711 and 712.

Furthermore, the first plate 600 may be formed with one or more first grooves 622 in which predetermined parts of the third and fourth fluid passage forming portions 620-1 and 620-2 are respectively protruded to the third and fourth fluid passage forming portions 720-1 and 720-2, thereby enhancing the durability and the brazing performance. The second plate 700 may be formed with one or more second grooves 723 in which predetermined parts of the third and fourth fluid passage forming portions 720-1 and 720-2 are respectively protruded to the third and fourth fluid passage forming portions 620-1 and 620-2, thereby enhancing the durability and the brazing performance.

Figure 11:
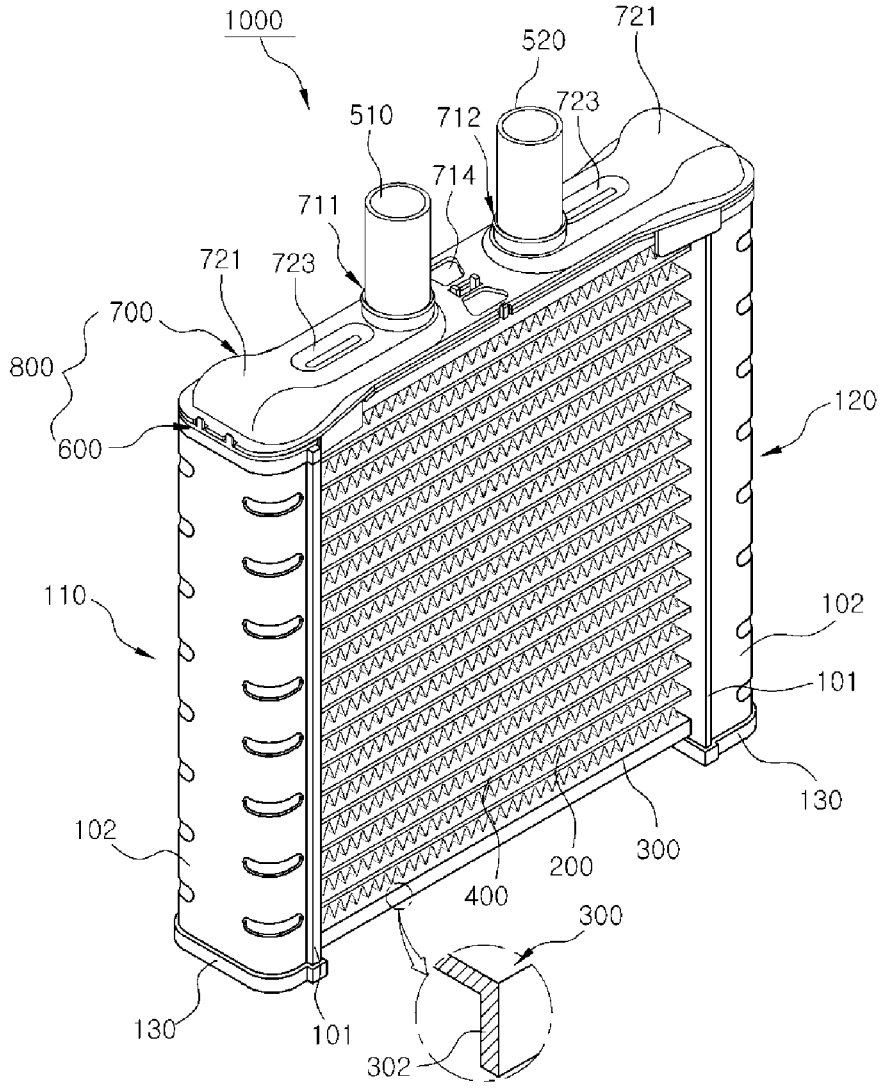
FIGS. 11 to 13 are a perspective view, an exploded perspective view and a cross-sectional view of a heater core according to yet another embodiment of the present invention.
Figure 13:
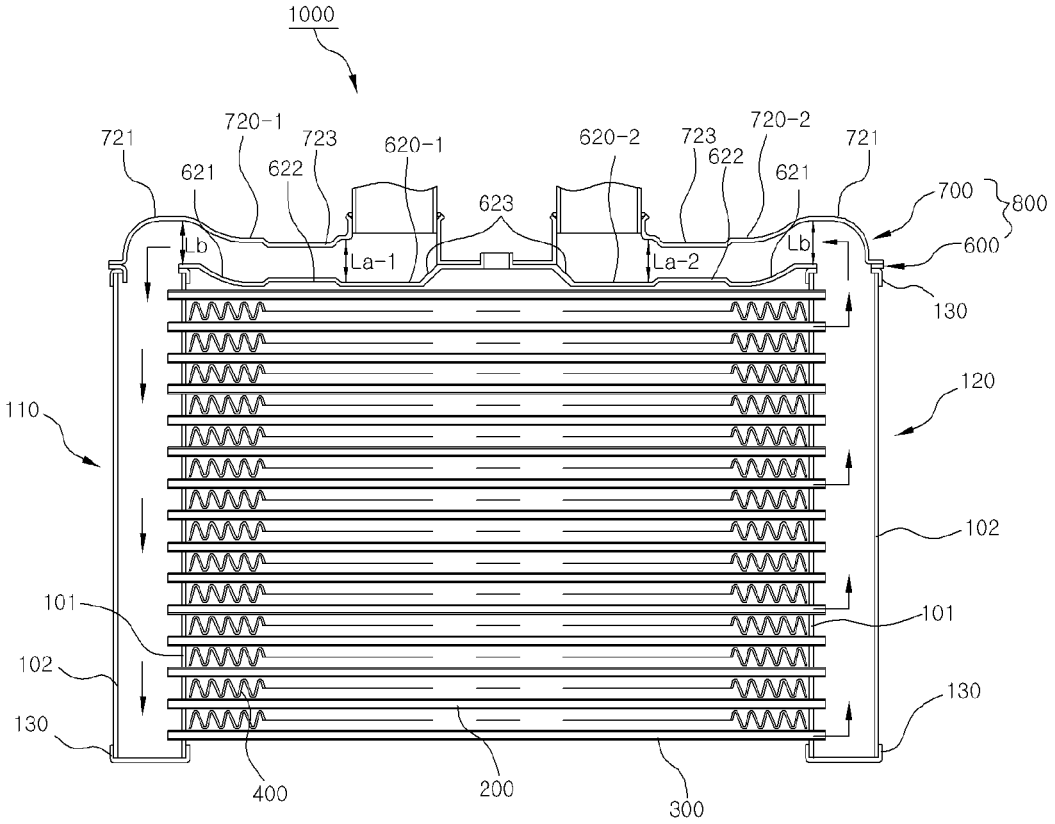
Figure 14:
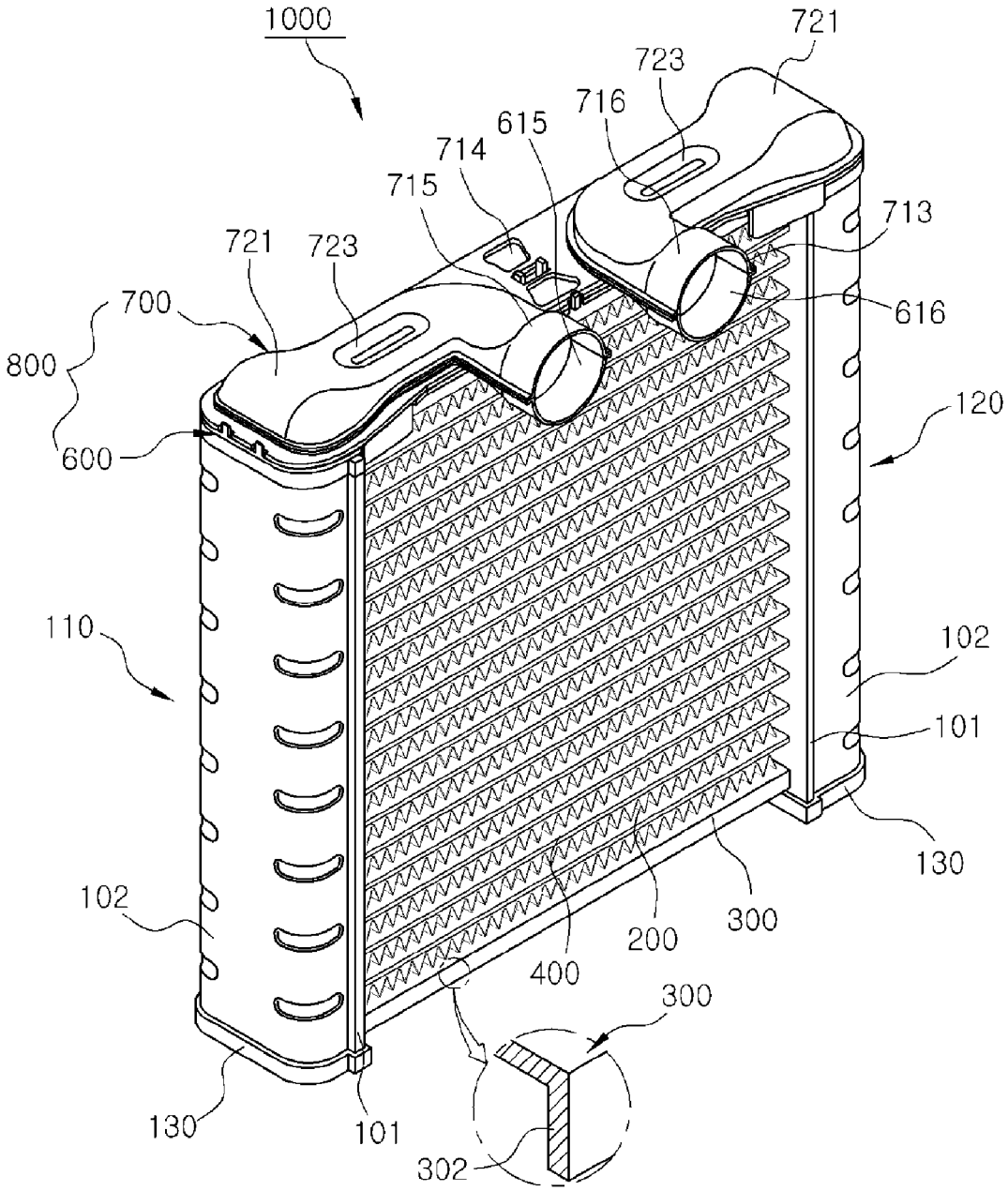
FIGS. 14 to 16 are a perspective view, an exploded perspective view and a cross-sectional view of a heater core according to yet another embodiment of the present invention.
Figure 16:
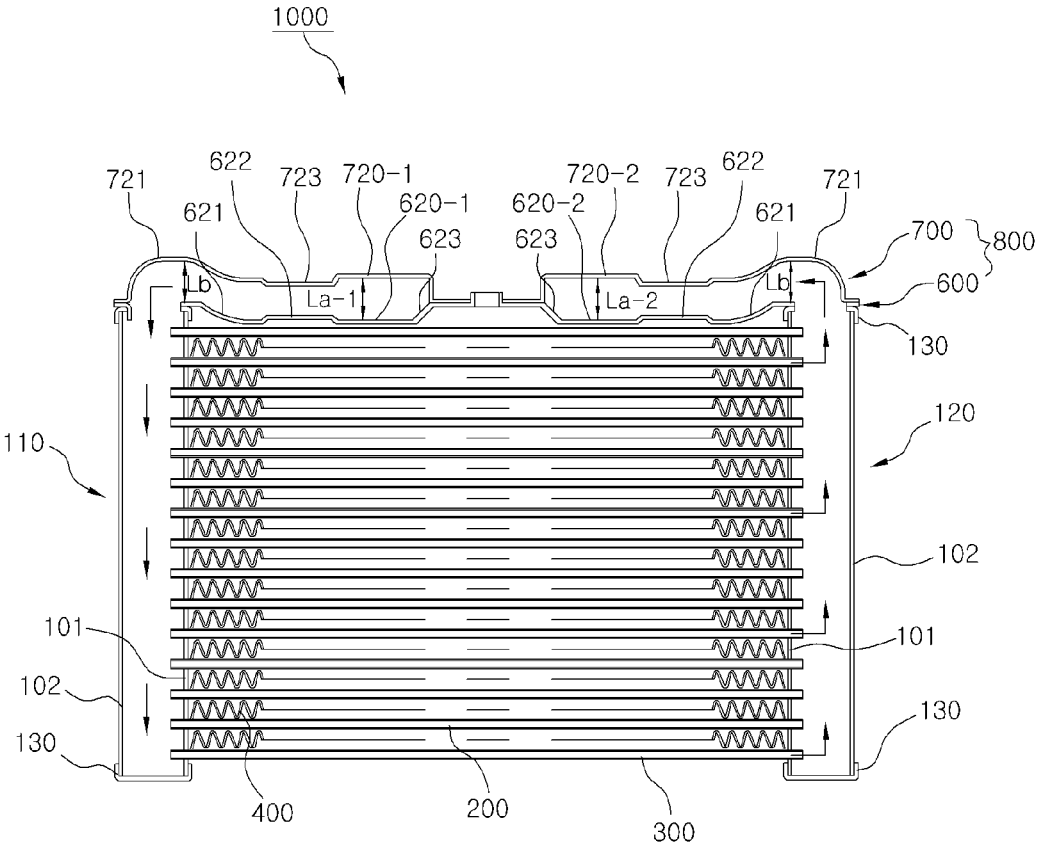

FIGS. 11 to 13 show an example that the first and second connection portions 711 and 712 are protruded outside the heater core 1000, and FIGS. 14 to 16 show an example that the first plate 600 is formed with the first and second pipe connection portions 615 and 616 which are extended to a front side of the heater core 1000, and the second plate 700 is formed with the third and fourth pipe connection portions 715 and 716 which are extended to a front side of the heater core 1000.

According to the present invention, since the heater core has the simple structure using the pipe connector formed by coupling the first plate and the second plate, it is possible to facilely manufacture the heater core. Since the extension portion is formed at a predetermined area of the second fluid passage forming portion, it is possible to secure the space defined in the flowing direction to the heater core by the first fluid and second fluid passage forming portion. And also, since the inlet pipe and the outlet pipe are disposed to be adjacent to each other, it is possible to provide a smaller size of the heater core.

Further, since each of the first and second plates is formed with the tab portion, the tab hole, the bent portion, and the mounting groove in which the welding ring for welding with the inlet and outlet pipes is mounted, it is possible to increase the coupling force, and also since the first and second plates are respectively formed with first and second grooves, it is possible to enhance durability thereof.

Furthermore, since the first curved portion and the second curved portion are respectively formed at the first and second fluid passages, it is possible to reduce the flow resistance of the heat exchange medium.

While the present invention has been described with respect to the specific embodiments, it will be apparent to those skilled in the art that various changes and modifications may be made without departing from the spirit and scope of the invention as defined in the following claims.

What is claimed is:

1. A heater core, comprising:

a first header tank;

a second header tank disposed in parallel with the first header tank, the second header tank being spaced apart from the first header tank by a predetermined distance;

a first cap attached to an end of the first header tank;

a second cap attached to another end of the second header tank;

a plurality of tubes inserted into the first header tank and the second header tank, the tubes of the plurality of tubes being configured to accommodate a heat exchange medium;

a plurality of fins interposed between the tubes of the plurality of tubes;

a side plate configured to support an outermost tube of the plurality of tubes or an outermost fin of the plurality of fins, the side plate including supporting portions protruding from a first side end and a second side end of the side plate;

a pipe connector coupled with one of the first side or the second side of the side plate;

an inlet pipe coupled with the pipe connector, the inlet pipe being configured to receive the heat exchange medium; and an outlet pipe coupled with the pipe connector, the outlet pipe being configured to discharge the heat exchange medium, wherein the pipe connector comprises:

a first plate including:

a first base portion, the first base portion having a first communication hole coupled with the first header tank, and a second communication hole coupled with the second header tank; and a first fluid passage forming portion, the first fluid passage forming portion being concave at a predetermined area of the first base portion and mounted in a space defined by the supporting portions of the side plate; and a second plate including:

a second base portion coupled with the first base portion of the first plate, a second fluid passage forming portion, the second fluid passage forming portion being convex at a predetermined area of the second base portion and opposed to the first fluid forming portion;

an extension portion further protruding in a width direction from a predetermined area of the first fluid passage forming portion and further protruding in a height direction from a predetermined area of the second fluid passage forming portion in a region opposed to the side plate, the predetermined area of the second fluid passage forming portion being substantially aligned with the first communication hole or the second communication hole in a direction toward the heater core;

a first connection portion protruded to an outside of the heater core and coupled with one of the inlet pipe or the outlet pipe; and a second connection portion adjacent and parallel to the first connection portion, the second connection portion being coupled with the other one of the inlet pipe or the outlet pipe, wherein the first plate further includes a bent portion, the bent portion having an extension tab extending toward an outside of the supporting portions of the side plate at a predetermined area of the first base portion of which a width is gradually increased to correspond to the extension portion.

2. The heater core of claim 1, wherein the first plate comprises a first pipe connection portion and a second pipe connection portion, the first pipe connection portion and the second pipe connection portion protrude toward a front side or a rear side of the heater core, the second plate comprises a third pipe connection portion corresponding to the first pipe connection portion and a fourth pipe connection portion corresponding to the second pipe connection portion, and one of the inlet pipe or the outlet pipe is coupled with an end of the first pipe connection portion and third pipe connection portion, and the other one of the inlet pipe or the outlet pipe is coupled with an end of the second pipe connection portion and fourth pipe connection portion.

3. The heater core of claim 1, wherein the first base portion of the first plate comprises a tab portion, and the second plate comprises a tab hole corresponding to the tab portion of the first plate.

4. The heater core of claim 1, wherein the bent portion is attached to a stepped portion formed at an adjacent surface between the side plate and the first header tank or the second header tank, and an outer surface of at least one of the supporting portions is connected with the first header tank or the second header tank.

5. The heater core of claim 1, wherein the first base portion comprises a protruded portion at one of the first communication hole or the second communication hole, the protruded portion being configured to be inserted into the first header tank or the second header tank.

6. The heater core of claim 1, wherein a height of the supporting portion on the side of the side plate coupled with the pipe connector is greater than a height of the supporting portion on the side of the side plate that is not coupled with the pipe connector.

7. The heater core of claim 1, wherein the second base portion is in contact with the first base portion in a region between the first connection portion and the second connection portion, and the second base portion has a hollowed portion in the region between the first connection portion and the second connection portion.

8. The heater core of claim 1, wherein the first fluid passage forming portion and the second fluid passage forming portion together form a first fluid passage, and the first base portion and the extension portion together form a second fluid passage, and a height of the first fluid passage is equal to a height of the second fluid passage.

9. The heater core of claim 1, wherein the first fluid passage forming portion of the first plate comprises a first curved portion in contact with the first cap or the second cap, the first curved portion having a first curved line, the second fluid passage forming portion of the second plate comprises a second curved portion in contact with the extension portion, the second curved portion having a second curved line, and the second curved line is parallel to the first curved line such that the second curved portion is parallel with the first curved portion.

10. The heater core of claim 1, wherein the first connection portion is communicatively coupled with the first communication hole, the second connection portion is on the second fluid passage forming portion, and the first fluid passage forming portion of the first plate comprises an inclined portion configured to guide the heat exchange medium to the second connection portion.

11. The heater core of claim 1, wherein the first plate comprises one or more first grooves such that a predetermined area of the first fluid passage forming portion protrudes toward the second fluid passage forming portion.

12. A heater core, comprising:

a first header tank;

a second header tank disposed in parallel with the first header tank, the second header tank being spaced apart from the first header tank by a predetermined distance;

a first cap attached to an end of the first header tank;

a second cap attached to another end of the second header tank;

a plurality of tubes inserted into the first header tank and the second header tank, the tubes of the plurality of tubes being configured to accommodate a heat exchange medium;

a plurality of fins interposed between the tubes of the plurality of tubes;

a side plate configured to support an outermost tube of the plurality of tubes or an outermost fin of the plurality of fins, the side plate including supporting portions protruding from a first side end and a second side end of the side plate;

a pipe connector coupled with one of the first side or the second side of the side plate;

an inlet pipe coupled with the pipe connector, the inlet pipe being configured to receive the heat exchange medium; and an outlet pipe coupled with the pipe connector, the outlet pipe being configured to discharge the heat exchange medium, wherein the pipe connector comprises:

a first plate including:

a first base portion, the first base portion having a first communication hole coupled with the first header tank, and a second communication hole coupled with the second header tank;

a first fluid passage forming portion, the first fluid passage forming portion being concave at a first predetermined area of the first base portion and mounted in a space defined by the supporting portions of the side plate, the first fluid passage forming portion being communicatively coupled with the first communication hole;

a second fluid passage forming portion, the second fluid passage forming portion being concave at a second predetermined area of the first base portion and mounted in the space defined by the supporting portions of the side plate, the second fluid passage forming portion being communicatively coupled with the second communication hole; and a second plate including:

a second base portion coupled with the first base portion of the first plate, a third fluid passage forming portion, the third fluid passage forming portion being convex at a first predetermined area of the second base portion and opposed to the first fluid passage forming portion;

a fourth fluid passage forming portion, the fourth fluid passage forming portion being convex at a second predetermined area of the second base portion and opposed to the second fluid passage forming portion;

a first extension portion further protruding from a first predetermined area of the third fluid passage forming portion in a first region opposed to the first header tank toward an outside of the heater core, the first extension portion further protruding in a width direction from a first predetermined area of the first fluid passage forming portion and further protruding in a height direction from a predetermined area of the third fluid passage forming a portion in a region opposed the side plate, the first predetermined area of the third fluid passage forming portion being substantially aligned with the first communication hole in a direction toward the heater core;

a second extension portion further protruding from a second predetermined area of the fourth fluid passage forming portion opposed to the second header tank toward the outside of the heater core, the second extension portion further protruding in a width direction from a second predetermined area of the second fluid passage forming portion and further protruding in a height direction from a predetermined area of the fourth fluid passage forming a portion in a region opposed the side plate, the second predetermined area of the fourth fluid passage forming portion being substantially aligned with the second communication hole in a direction toward the heater core;

a first connection portion protruded to an outside of the heater core and coupled with one of the inlet pipe or the outlet pipe; and a second connection portion adjacent and parallel to the first connection portion, the second connection portion being coupled with the other one of the inlet pipe or the outlet pipe, wherein the first plate further includes a bent portion, the bent portion having an extension tab extending toward an outside of the supporting portions of the side plate at a predetermined area of the first base portion of which a width is gradually increased to correspond to the extension portion.

13. The heater core of claim 12, wherein the first plate comprises a first pipe connection portion and a second pipe connection portion, the first pipe connection portion and the second pipe connection portion protrude toward a front side or a rear side of the heater core, the second plate comprises a third pipe connection portion corresponding to the first pipe connection portion and a fourth pipe connection portion corresponding to the second pipe connection portion, and one of the inlet pipe or the outlet pipe is coupled with an end of the first pipe connection portion and third pipe connection portion, and the other one of the inlet pipe or the outlet pipe is coupled with an end of the second pipe connection portion and fourth pipe connection portion.

14. The heater core of claim 12, wherein the first base portion of the first plate comprises a tab portion, and the second plate comprises a tab hole corresponding to the tab portion of the first plate.

15. The heater core of claim 12, wherein the bent portion is attached to a stepped portion formed at an adjacent surface between the side plate and the first header tank or the second header tank, and an outer surface of at least one of the supporting portions is connected with the first header tank or the second header tank.

16. The heater core of claim 12, wherein the first base portion comprises a protruded portion at one of the first communication hole or the second communication hole, the protruded portion being configured to be inserted into the first header tank or the second header tank.

17. The heater core of claim 12, wherein a height of the supporting portion on the side of the side plate coupled with the pipe connector is greater than a height of the supporting portion on the side of the side plate that is not coupled with the pipe connector.

18. The heater core of claim 12, wherein the second base portion is in contact with the first base portion in a region between the first connection portion and the second connection portion, and the second base portion has a hollowed portion in the region between the first connection portion and the second connection portion.

19. The heater core of claim 12, wherein the first fluid passage forming portion and the third fluid passage forming portion together form a first fluid passage, the second fluid passage forming portion and the fourth fluid passage forming portion together form a second fluid passage, the first base portion and the first extension portion together form a third fluid passage, and a height of the first fluid passage is equal to a height of the second fluid passage, and a height of the third fluid passage is equal to the height of the first fluid passage.

20. The heater core of claim 12, wherein the first fluid passage forming portion comprises a first curved portion in contact with the first cap or the second cap, the first curved portion having a first curved line, the second fluid passage forming portion comprises a second curved portion in contact with the other of the first cap or the second cap, the second curved potion having a second curved line, the third fluid passage forming portion comprises a third curved portion in contact with one of the first extension portion or the second extension portion, the third curved portion having a third curved line, the fourth fluid passage forming portion comprises a fourth curved portion in contact with the other of the first extension portion or the second extension portion, the fourth curved portion having a fourth curved line, the third curved line is parallel to the first curved line such that the third curved portion is parallel with the first curved portion, and the fourth curved line is parallel to the second curved line such that the fourth curved portion is parallel with the second curved portion.

21. The heater core of claim 12, wherein the first connection portion is formed on the third fluid passage forming portion, the second connection portion is formed on the fourth fluid passage forming portion, the first fluid passage forming portion of the first plate comprises a first inclined portion configured to guide the heat exchange medium to the first connection portion, and the second fluid passage forming portion of the first plate comprises a second inclined portion configured to guide the heat exchange medium to the second connection portion.

22. The heater core of claim 12, wherein the first plate comprises one or more first grooves such that predetermined areas of the first fluid passage forming portion and the second fluid passage forming protrude toward the third fluid passage forming portion and the fourth fluid passage forming portion.

* * * * *